US008897684B2

(12) United States Patent
Fromm

(10) Patent No.: US 8,897,684 B2
(45) Date of Patent: Nov. 25, 2014

(54) APPARATUS, METHOD AND SYSTEM FOR CONTROLLING STRIP RADIUS IN A FUSER UNIT USEFUL IN PRINTING

(75) Inventor: Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 135 days.

(21) Appl. No.: 13/495,101

(22) Filed: Jun. 13, 2012

(65) Prior Publication Data

US 2013/0336683 A1 Dec. 19, 2013

(51) Int. Cl.
*G03G 15/20* (2006.01)

(52) U.S. Cl.
USPC ..... 399/323

(58) Field of Classification Search
USPC ..... 399/323, 333
See application file for complete search history.

(56) References Cited

U.S. PATENT DOCUMENTS

| | | | | |
|---|---|---|---|---|
| 4,284,875 | A * | 8/1981 | Namiki et al. | 219/216 |
| 4,425,694 | A * | 1/1984 | Somerville | 271/272 |
| 4,501,482 | A * | 2/1985 | Stryjewski | 399/333 |
| 4,823,689 | A * | 4/1989 | Kishino et al. | 100/155 R |
| 6,819,890 | B1 * | 11/2004 | Bott et al. | 399/67 |
| 2011/0311249 | A1 * | 12/2011 | Kubota et al. | 399/44 |

* cited by examiner

*Primary Examiner* — Quana M Grainger
(74) *Attorney, Agent, or Firm* — Ronald E. Prass, Jr.; Prass LLP

(57) ABSTRACT

An apparatus, system and method are provided for controlling a nip pressure profile at a fusing nip and a strip radius in a fuser. The fuser has a first pressure member configured to be inflatable comprising one or more radial webs configured to extend between an external portion of the first pressure member and an internal member of the first pressure member. The fuser also has a second pressure member that having a surface that faces a surface of the first pressure member at a region defining a fusing nip. The second pressure member is configured to cause a deformation of the first pressure member to cause, at least in part, a selectable strip radius.

25 Claims, 9 Drawing Sheets

APPARATUS, METHOD AND SYSTEM FOR CONTROLLING STRIP RADIUS IN A FUSER UNIT USEFUL IN PRINTING

FIELD OF DISCLOSURE

The disclosure relates to fuser apparatuses, methods and systems useful in printing. Specifically, the disclosure relates to a fuser and/or a belt-roll fuser that maintains a nip pressure profile at a fusing nip and controls a strip radius magnitude by way of an inflatable pressure member.

BACKGROUND

Conventional fusers include an internal pressure roll ("IPR"), and an external pressure roll ("EPR"). Some fusers such as belt-roll fusers entrain a fuser belt between the IPR and the EPR. A fusing nip is conventionally defined by a region under pressure between the EPR and the IPR in either type of fuser unit. Some conventional fusers utilize a hard IPR and a soft EPR to form a fusing nip for fusing an image to a substrate that has just received toner from a transfer station. FIG. 1 illustrates an example of a related art belt-roll fuser architecture.

Conventional belt-roll fusers often have a stripping shoe that is used to load an inner side of the fusing belt to generate an effective fusing nip pressure in a region beyond the region under pressure between the EPR and the IPR. While the stripping shoe may help generate an effective fusing nip pressure, belt-roll fusers that utilize conventional IPR and EPR architecture with a stripping shoe still often face image related defects such as, but not limited to, gloss related image quality ("IQ") defects, stripping performance, and failure to demonstrate process latitude. These issues are caused by a variance in pressure in the fusing nip that results from the inherently required discontinuity between the end of the roll to roll contact zone and the start of the stripping shoe. Maintenance costs may also be increased by the presence of the stripping shoe because of wear that the stripping shoe may experience or cause on the fuser belt, thereby requiring frequent repair and/or replacement.

SUMMARY

Apparatuses, methods and systems for use in printing are disclosed. Various exemplary embodiments improve image quality performance of belt-roll fusers by maintaining an effective nip pressure profile at a fusing nip and controlling a strip radius at least by way of an inflatable pressure member. In some embodiments, the inflatable pressure member may be provided in lieu of the conventional stripping shoe and/or a conventional IPR.

According to one embodiment, an apparatus useful in printing comprises a first pressure member configured to be inflatable comprising one or more radial webs configured to extend between an external portion of the first pressure member and an internal member of the first pressure member in a direction toward a center of the internal pressure member. The apparatus additionally comprises a second pressure member that faces a surface of the first pressure member at a region defining a fusing nip. The second pressure member is configured to cause a deformation of the first pressure member to cause, at least in part, a selectable strip radius downstream of the fusing nip in a process direction.

According to another embodiment, a method for stripping a substrate from a fuser member comprises defining a fusing nip in an apparatus useful in printing. The apparatus comprises a first pressure member configured to be inflatable comprising one or more radial webs configured to extend between an external portion of the first pressure member and an internal member of the first pressure member in a direction toward a center of the internal pressure member. The apparatus further comprises a fuser belt having a portion that faces a surface of the first pressure member at the fusing nip. The apparatus additionally comprises a second pressure member that faces a surface of the first pressure member at a region defining a fusing nip. The method also comprises causing, at least in part, a selectable strip radius downstream of the fusing nip in a process direction by causing a deformation of the first pressure member with the second pressure member. The method further comprises causing, at least in part, stripping of the substrate downstream of the fusing nip in a process direction.

According to another embodiment, a system useful in printing configured to strip a substrate comprises a first pressure member configured to be inflatable comprising one or more radial webs configured to extend between an external portion of the first pressure member and an internal member of the first pressure member in a direction toward a center of the internal pressure member. The system additionally comprises a second pressure member that a surface of the first pressure member at a region defining a fusing nip. In the system, the second pressure member is configured to cause a deformation of the first pressure member to cause, at least in part, a selectable strip radius downstream of the fusing nip in a process direction, and the substrate is stripped at a position on the selectable strip radius.

According to another embodiment, A method for manufacturing an inflatable roll useful in printing comprises causing, at least in part, one or more loops of a sheeted material having a first end and a second end to be fabricated by folding the sheeted material over onto itself to form each of the one or more loops. The method also comprises causing, at least in part, a number of loops to be formed to form the radial webs. The method further comprises causing, at least in part, the first end and the second end of the sheeted material to be bound together to form a tube. The method additionally comprises causing, at least in part, the one or more loops to be folded in one direction.

The method also comprises causing, at least in part, the tube to be inserted into a curable sleeve. The method further comprises causing, at least in part, an air bladder to be inserted inside the tube to form an assembly. The method additionally comprises causing, at least in part, the assembly to be enclosed in a mold. The method also comprises causing, at least in part, the air bladder to be inflated. The method further comprises causing, at least in part, the air bladder to be inflated during a curing process to cure the sleeve until the sleeve is cured.

The method additionally comprises causing, at least in part, the mold and the air bladder to be removed. The method also comprises causing, at least in part, the one or more loops to unfold to form one or more respective radial webs that are configured to be connected to a core. The method further comprises causing, at least in part, the radial webs to be connected to the core.

Exemplary embodiments are described herein. It is envisioned, however, that any system that incorporates features of any apparatus, method and/or system described herein are encompassed by the scope and spirit of the exemplary embodiments.

DETAILED DESCRIPTION

Figure 1:
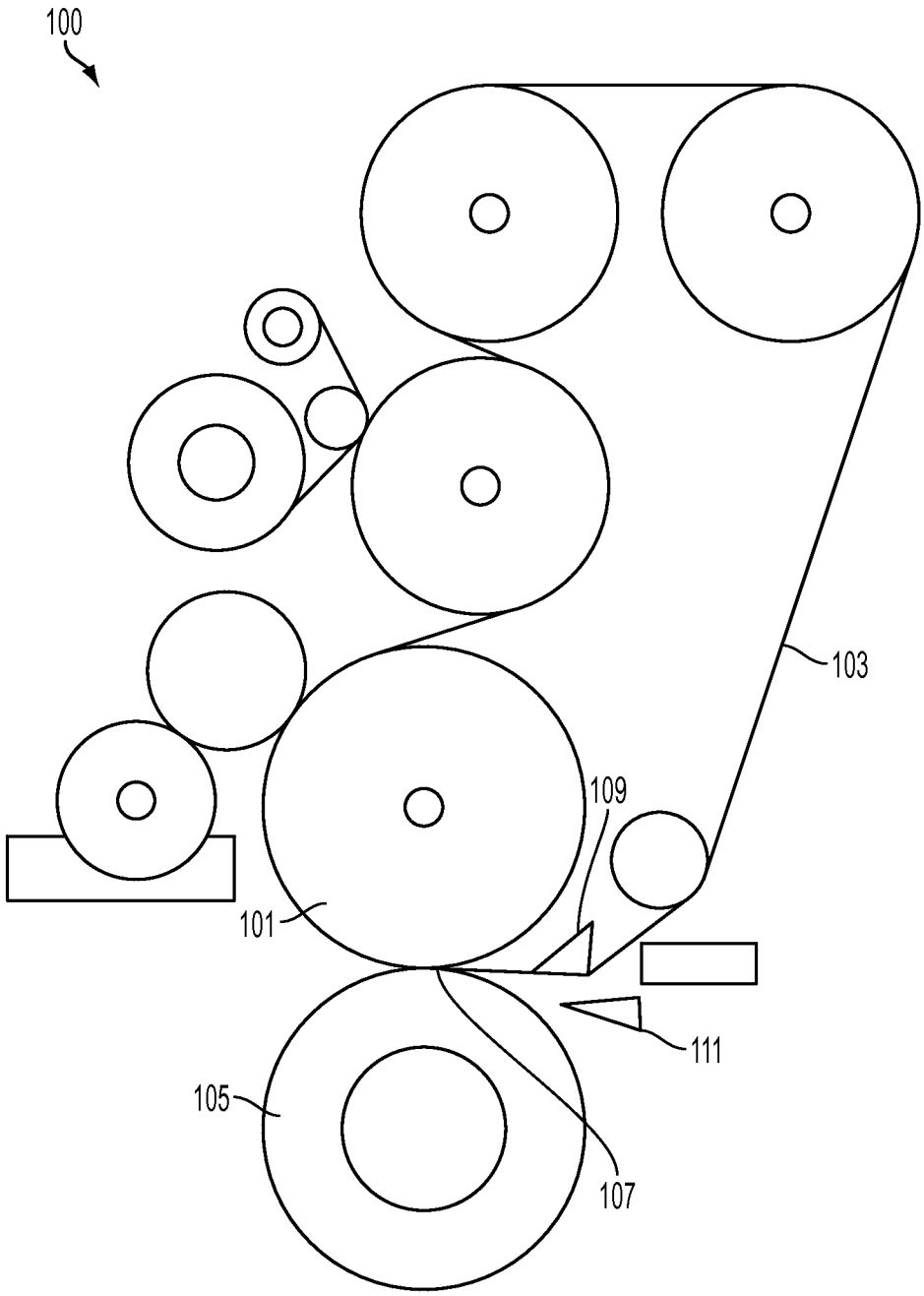
FIG. 1 is a diagrammatical side view of a related art belt-roll fuser.

Exemplary embodiments are intended to cover all alternatives, modifications and equivalents as may be included within the spirit and scope of the apparatuses, methods and systems as described herein.

Reference is made to the drawings to accommodate understanding of disclosed apparatuses, methods and systems useful in printing. In the drawings, like reference numerals are used throughout to designate similar or identical elements. The drawings depict various embodiments related to embodiments of illustrative apparatuses, methods and systems for maintaining a nip pressure profile at a fusing nip and controlling a strip radius by way of an inflatable pressure member.

Apparatuses and systems of embodiments may include systems for printing images on media by fusing marking material to a substrate using a belt-roll fuser.

FIG. 1 illustrates a diagrammatical side view of an example related art belt-roll fuser 100. Conventional belt-roll fusers utilize a hard IPR 101, which entrains a fuser belt 103, and a soft EPR 105. The IPR 101, fuser belt 103 and EPR 105 form a fusing nip 107 for fusing an image to a substrate that has just received toner from a transfer station.

The substrate may be any form of media upon which marking material, such as toner, may be deposited. The substrate may be fed by the belt-roll fuser 100 through the fusing nip 107 in a process direction from a nip entrance to a nip exit. The belt-roll fuser 100 may then be configured to apply, e.g., pressure and heat at the fusing nip 107 to fuse a marking material to the substrate.

The fuser belt 103 may be entrained by one or more components of the belt-roll fuser 100. For example, the fuser belt 103 may have a first side and a second side. The first side, for example, may be an inner side that contacts the IPR 101, and may also contact other members of the belt-roll fuser 100 that may entrain the fuser belt 103. The second side may contact a substrate that passes through the fusing nip 107.

Belt-roll fusers that utilize conventional IPR and EPR architecture such as that illustrated in FIG. 1 often face image related defects such as, but not limited to, gloss related IQ defects, stripping performance, and failure to demonstrate process latitude. These issues may be due to variability in fusing nip geometry caused by variables such as IPR and/or EPR elastomer bulge, temperature variation, shoe location, and inboard to outboard nip dynamics.

To help with the aforementioned image related defects, the related art belt-roll fuser 100 illustrated in FIG. 1 uses a strip shoe 109 to load and bend the fuser belt 103 to a small radius to aid in stripping of a substrate from the fuser belt 103. The belt-roll fuser 100 also uses an air knife 111 to aid in stripping the substrate from the fuser belt 103. Paper tends to stick to the fuser belt 103 after passing through the fusing nip 107. The strip shoe 109 provides a small (<5 mm) stripping radius such that the paper will peel away from the fuser belt 103. However, because the fuser belt 103 wraps around the outside of the strip shoe 109, the related art belt-roll fuser 100 design results in a fusing nip 107 that has three different zones.

These three different zones result in varying nip pressure throughout the fusing nip 107 and cause inconsistent stripping performance, which in turn causes the above-mentioned image-related defects. The presence of the strip shoe 109 also increases maintenance costs because it may cause wear on various components of the belt-roll fuser 100, such as fuser belt 103. These features, accordingly, may require frequent repair and/or replacement. The strip shoe 109 itself may also wear and require repair and/or replacement as well.

Figure 2:
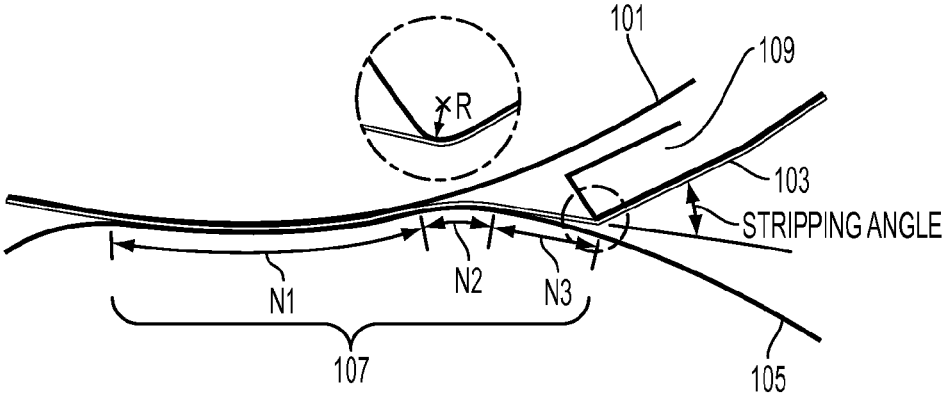
FIG. 2 is a diagrammatical side view of a fusing nip of a related art belt-roll fuser.

FIG. 2 illustrates a diagrammatical side view of the geometry of the fusing nip 107, as discussed above. The fusing nip 107 is divided into three zones caused by conventional dual-roll architecture and the presence of the strip shoe 109. First, a primary, high-pressure, fusing nip (N1) is defined by a region generated by the interference of the IPR 101 and the EPR 105. Second, a low pressure contact nip (N2) is defined by a region in which the fuser belt 103 is in contact with the EPR 105 and not in contact with the IPR 101. Third, a free span (N3) is defined by a region between N2 and the strip shoe 109 where the fuser belt 103 is not in contact with either the IPR 101 or the EPR 105.

This three-nip geometry results in varying nip pressure throughout the fusing nip 107 and causes inconsistent stripping performance, which in turn causes the above-mentioned image-related defects. For example, the unsupported free span N3 may be one of the causes of image gloss defects. As the lead edge of a substrate travels through N2, substrates such as heavyweight sheets, for example, often do not conform to the shape of the EPR 105 with only belt tension producing a downward force (pressure in N2 may be less than 10 psi, for example). The downward force is only produced by belt tension in N2 in this example because the fuser belt 103 is no longer in contact with the IPR 101. Accordingly, because of the beam strength of the substrate, it may separate from the fuser belt 103, then retouch later as the beam length of the substrate increases. This separation and retouching causes a gloss defect called "icicles."

Additionally, for example, depending on the density and location of an image, a substrate can stick to the fuser belt 103 or to the EPR 105 as it travels through the free span N3. The substrate may separate from and retouch the fuser belt 103 in the free span N3 causing image quality defects known as "retack."

It is difficult to orient the strip shoe 109 to eliminate the N2 and N3 regions. The N2 and N3 regions, as discussed above are caused the small distance between the end of the deformed rubber of the IPR 101 and beginning or the strip shoe 109 resulting in variances in pressure in the fusing nip 107. While the strip shoe 109 may be positioned to optimize stripping performance and minimize the image defects, its positioning is difficult to perfect because of thermal expansion that may occur in the IPR 101, the EPR 105 and/or the fuser belt 103, as well as uncontrolled bulges that occur in the IPR 101 and/or the EPR 105 beyond the indentation of the IPR 101 in the N2 portion of fusing nip 107. It is further difficult to perfectly place the strip shoe 109 because of various wearing that may occur on any of the IPR 101, EPR 105, fuser belt 103 and strip shoe 109, as well as changes in durometer of the IPR 101 and/or the EPR 105.

Accordingly, there is a need for a fuser system that provides reliable stripping performance without the need for a strip shoe 109 while effectively driving the N2 and N3 regions to zero by controlling nip geometry and strip radius.

Figure 3:
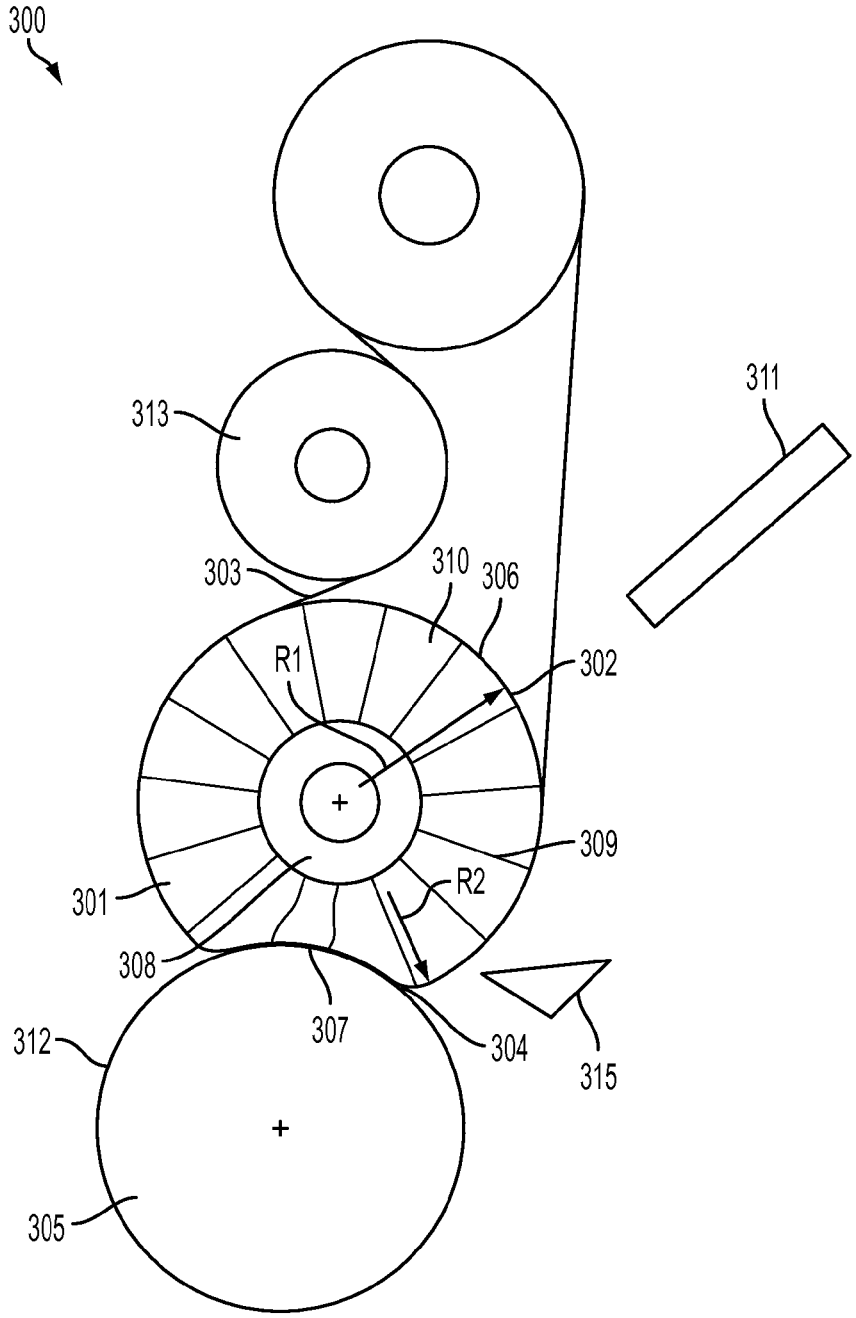
FIG. 3 is a cross-sectional side view of a belt-roll fuser having an inflatable pressure member, according to one example embodiment.

FIG. 3 illustrates a cross-sectional side view of a fuser 300 that controls nip geometry and a strip radius magnitude to affect image quality and stripping performance without the need of a strip shoe, according to one embodiment. The nip geometry, as discussed in more detail below, is controlled by replacing the conventional IPR 101 discussed above with an inflatable pressure member, for example.

The fuser 300 is illustrated as a belt-roll fuser that includes an inflatable pressure member such as IPR 301 configured to entrain a fuser belt 303. Though illustrated as a belt-roll fuser, it should be understood that the fuser 300 may be any other type of fuser system that does not include the fuser belt 303. For example, such a fuser may be configured to fuse an image to a substrate by having the substrate directly contact the IPR 301, or by contacting an intermediary deformable sleeve 306 that surrounds the IPR 301. Regardless of fuser type, the fuser 300 eliminates the need for a strip shoe or surface strain or high rubber stress and strain to produce a small bulge radius, and thereby eliminates the uneven pressure profiles that occur in the fusing nip region discussed above while providing a controllable strip radius magnitude.

IPR 301, in this example, may be an inflatable drum or roll that is rotatable about its longitudinal axis. The IPR 301 may comprise any elastomer material, rubber, polymer and/or metal. The fuser 300 further includes another pressure member such as EPR 305. EPR 305 may comprise any elastomer material, rubber, polymer, and/or metal. The EPR 305 may be configured to deform an amount that is less than or equal to an amount of deformation that the IPR 301 may be configured to deform under an equal pressure. In at least one embodiment, the IPR 301 may be configured to deform under a predetermined pressure while the EPR 305 may be configured to remain fixed under the same predetermined pressure. In another embodiment, the EPR 305 may also be an inflatable pressure member that has the same or similar features as IPR 301. Or the EPR 305 may directly contact the substrate to fuse the image to the substrate just like the IPR 301, if the fuser 300 is so arranged, and may optionally comprise an intermediary outer sleeve 306 that replaces the fuser belt 303 to contact the substrate and fuse an image to a surface of the substrate.

If the fuser 300 is outfitted with one or more sleeves 306 and 312, the sleeves 306, 312 may be attached to their respective IPR 301 and/or EPR 305 to stay in place, or may be held in place by inflating one or more of the IPR 301 and EPR 305 depending on the embodiment.

Inflatable pressure members may be a good choice for forming a nip because any stress and strain experienced in any surfaces of the IPR 301 may be nearly independent of a deformation caused by another roller such as the EPR 305. This independence allows for a very wide range of nip widths to be formed with one configuration of an IPR 301. For example, by altering the internal pressure of the IPR 301, the nip width may be adjusted on demand, as well as a strip radius at an exit of a fusing nip 307. Conversely, solid rubber rolls, such as those in the conventional belt-roll fuser 100 discussed above, have a strong stress sensitivity with respect to indentation and nip width, and may not be easily adjusted to cause varying nip widths and/or strip radii on demand.

The IPR 301, fuser belt 303, and EPR 305 define the fusing nip 307 in a region at which the IPR 301 and the fuser belt 303 are in contact with one another, and the EPR 305 and the fuser belt 303 are in contact with one another. Alternatively, the fusing nip 307 may be defined by a region in which the IPR 301 and EPR 305 are in contact with one another if the fuser 300 does not have a fuser belt 303. In the fusing nip 307, the IPR 301 may be configured to deform so that an exterior surface of the IPR 301 conforms to the shape of an exterior surface of the EPR 305. Pressure may then be uniformly applied to a substrate throughout the fusing nip 307 in a region in which the fuser belt 303 is in contact with the IPR 301 and the EPR 305, or the IPR 301 and EPR 305 are in contact with one another. Accordingly, in this region, the uniform pressure may be applied to the fuser belt 303 and/or any media that may also pass through the fusing nip 307 in a process direction. This region may be considered to correspond to at least the N1 region discussed above with respect to FIG. 2.

In one or more embodiments, pressure distribution in the fusing nip 307 is nearly uniform from nip entrance to nip exit, whereas in a conventional system architecture the pressure distribution may be parabolic. Accordingly, pressure in the fusing nip 307 at the nip exit is higher than in a conventional belt-roll fuser, which results in a maximization of the desired effect of the nip pressure because a resulting longer heating time softens the toner to a further degree in the fuser 300 compared to that of a conventional belt-roll fuser such as belt-roll fuser 100, discussed above, where the peak pressure is exerted in the middle of the heating time and the toner is more rigid.

Additionally, the uniform nip pressure relative to the EPR 305 may compress any unfused toner sooner than in a conventional belt-roll fuser with varying nip pressure. Such uniform pressure may cause optimal fusing pressure right up to the nip exit. At the nip exit, the toner is at its maximum temperature because it has been in the fusing nip 307 that is effectively greater in width than a conventional fusing nip such as the N1 region discussed above. This may enable a slight temperature reduction for fusing compared to conventional belt-roll fuser 100, or allow for lower average pressure in the fusing nip 307. This may also keep any super heated water in the fuser 300 from turning to steam in the fusing nip 307.

Such changes in system dynamics may improve image quality because in a conventional belt-roll fuser such as belt-roll fuser 100, a substrate may separate from the fuser belt prematurely in the N2 and/or N3 regions, thereby resulting in insufficient fusing time. But, if the fusing time were increased by maintaining a uniform pressure profile throughout the fusing nip, and eliminating the N2 and N3 regions discussed above, the IQ defects that are caused by the presence of the conventional strip shoe 109 may be avoided.

According to one example embodiment, the IPR 301 may comprise a core 308, one or more radial webs 309, and an outer cylinder 310 that may be comprised of the same or different materials as one another such as any elastomer material, rubber, polymer and/or metal, for example. The radial webs 309 may be configured to support the outer cylinder 310 of the IPR 301 so that the IPR 301 maintains its shape when under pressure from the EPR 305 in a region other than the fusing nip 307. The radial webs, however, are flexible to enable the IPR 301 to be deformed under pressure. The outer cylinder 310 is allowed to move closer to the core 308 but the radial webs 309 maintain axial parallelism and approximate concentricity of the outer cylinder 310 to the rigid core 308 in areas outside the contact with EPR 305. Any dimensions such as thickness, shape, or length of the radial webs 309, or any thickness of the outer cylinder 310 may be optimized to reduce bending stiffness of the IPR 301. In one or more embodiments, the core 308 may be rigid or flexible depending on a degree of desired flexibility and give that the core 308 may provide when the IPR 301 is under a pressure.

In one or more embodiments, the radial webs 309 may be pre-tensioned to control strip radius and a degree of deformation of the IPR 301. For example, if the radial webs 309 are pre-tensioned to pull the outer cylinder 310 to a radius smaller than the circumference of the outer cylinder 310, the bend radius at the nip exit may be minimized. This tension may result in an outer cylinder 310 shape that may affect the strip radius formed by the interaction of EPR 305 with IPR 301. In one or more embodiments, the radial webs 309 may be fabricated by any means such as by way of simple folding and welding of sheet stock polyimide or other material inside of the outer cylinder 310.

The IPR 301 may be inflated with any fluid and/or gas such as, but not limited to, air, water, oil, etc. The IPR 301, in this example, is a roll that has the outer cylinder 310 which has an exterior surface 302 having a radius R1. To reduce or eliminate the N2 and N3 regions discussed above with regard to FIG. 2, the radius R1 of the exterior surface 302 of IPR 301 is altered by a deformation caused by the EPR 305 such that the exterior surface 302 of IPR 301 has a strip radius 304 having a radius R2 formed downstream of the fusing nip 307 in the process direction.

The magnitude of radius R2, according to various embodiments, may be less than the magnitude of radius R1. In one or more embodiments, the radius R2 may be less than 5 mm, for example. To cause the deformation, the EPR 305, as discussed above, may be configured to deform an amount less than that the IPR 301 is configured to deform under an equal pressure. The difference in radius may be dependent on a width of the fusing nip 307 that is desired, or selectable strip radius 304, as well as a selected internal pressure of the IPR 301.

According to various example embodiments, the IPR 301 may be configured to have a selectable internal pressure such that the width of the fusing nip 307 and the magnitude of stripping radius R2 may be varied on demand. The magnitude of the stripping radius R2 may have an effect on the stripping performance of the fuser 300 which could vary based on substrate type, substrate weight, and/or weather conditions such as temperature and humidity, for example. For example, the fuser 300 may adjust the internal pressure to accommodate a booklet or a stack of substrates that is passed through the fusing nip 307, for example. In various embodiments, the internal pressure may also be varied to cause a deformation that performs other tasks such as drawing a sheet from a stack of substrates when the IPR 301 is deformed, and not drawing sheets from the stack when the IPR 301 is not deformed. Accordingly, a pressure control member 311 may cause the pressure inside the IPR 301 to change by causing more or less of the fluid and/or gas to be input or released from the IPR 301 so as to effect a change in the fusing nip geometry such as nip width and/or the strip radius 304. Incidentally, a fusing pressure in the fusing nip 307 may be equal to the internal pressure of the IPR 301. Accordingly, the fusing pressure may be selectively changed and varied by the pressure control member 311 on demand.

The pressure control member 311 may be any type of pump, for example, or other device that enables the IPR 301 to be inflated or deflated on demand to cause a selected pressure in the IPR 301. The variance in internal pressure, as discussed above enables the fusing nip 307 width, as well as the strip radius 304, to be controlled to a desired amount to provide effective stripping.

In one or more embodiments, the pressure control member 311 may be configured to quickly inflate or deflate the IPR 301 between print jobs or even during such that fusing pressure, nip width and/or stripping radius may be optimized. For example, one print job may require a particular fusing pressure and strip radius compared to another print job, so the IPR 301 may be inflated or deflated on demand to accommodate the various print job requirements. Alternatively, a fusing pressure may be increased as a substrate enters the fusing nip by inflating the IPR 301, but then the strip radius may be decreased at an optimum moment if desired by deflating the IPR 301 at the opportune time in the print process. In some embodiments, the internal pressure may be changed in less than a second, for example.

The variance in pressure within the IPR 301 may also allow for different belt sizes of the fuser belt 303 to be accommodated if the fuser 300 is a belt-roll fuser. For example, thicker or thinner belts may be used in the fuser 300 for different print job requirements, varying performance requirements such as printer speed, or to accommodate heavier or lighter substrates, as well as to account for thermal expansion of the components of the fuser 300 such as the IPR 301 and/or the EPR 305. To accommodate expansion of the IPR 301, a thinner fuser belt 303 may be used in the fuser 300 to help maintain a predetermined stripping radius R2. However, because belt sizes may vary, and availability may be limited, the internal pressure of the IPR 301 could be controlled by the pressure control member 311 so that regardless of the size of belt that is available, the predetermined stripping radius R2 may be maintained.

Additionally, altering the internal pressure of the IPR 301 to provide an optimal stripping radius R2 may allow for a reduction in the necessary thickness of fuser belt 303, as well as any coating thereon. Such a reduction in thickness may have an effect on the performance of the fuser 300 such as improving image quality and consistency. A thinner coating, for example, would effectively reduce an amount of possible deformation that could occur to the fuser belt 303 as a result of pressure in the fusing nip 307, or any thermal expansion the fuser belt 303 could experience in the fusing nip 307.

In one or more embodiments, the IPR 301 may be configured to additionally perform maintenance functions such as cleaning and/or conditioning the fuser belt 303. For example, if the IPR 301 is inflated using an oil, the IPR 301 could be configured to distribute oil onto the fuser belt 303 on demand while maintaining the selected internal pressure in the IPR 301.

Various means of heating and oiling can be employed in the fuser 300 in addition to the oiling discussed above. Additionally, the fuser 300 may include a heating element 313, which may be a roller, that preheats the fuser belt 303 before it reaches the fusing nip 307. However, if the IPR 301 is inflated using a heat conducting fluid, for example, the fluid may also be heated in addition to, or in lieu of, the heating element 313 so that the IPR 301 may itself heat the fuser belt 303 to effect fusing in the fusing nip 307. Or the heating element 313 may simply heat at least an outer surface of the IPR 301 to facilitate fusing an image to a substrate.

In one or more embodiments, while the selectable internal pressure of the IPR 301 is controlled to reduce or eliminate the N2 and N3 regions discussed above to improve stripping performance, and a substrate may strip at an optimal moment on its own, the fuser 300 may further include an air knife 315 to aid in stripping the substrate from the fuser belt 303 or the IPR 301, for example. For example, should the substrate stick to the fuser belt 303 or the IPR 301, the air knife 315 may cause the substrate to separate from the fuser belt 303 or the IPR 301.

Figure 4:
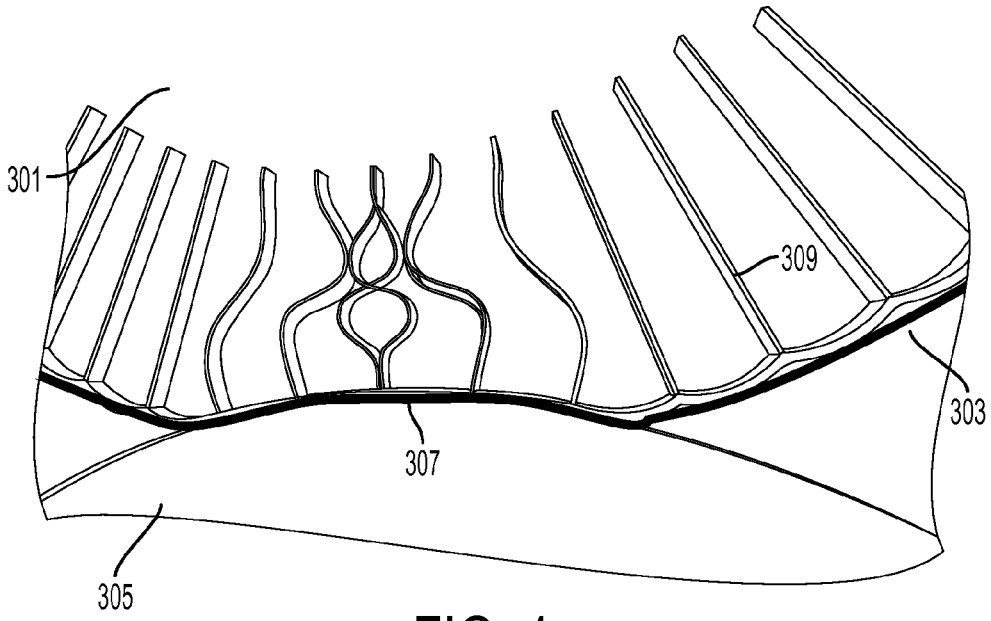
FIG. 4 is a cross-sectional side view of an inflatable pressure member in a deformed state, according to one example embodiment.

FIG. 4 illustrates a cross-sectional side view of the IPR 301 being deformed by the EPR 305. In this example, the IPR 301 is inflated to a degree that allows for the EPR 305 to cause the IPR 301 to deform so as to conform to the shape of an outer surface of the EPR 305 in the fusing nip 307. The fuser belt 303 is entrained between the IPR 301 and the EPR 305 in the fusing nip 307 such that there is a uniform pressure on the fuser belt 303 in the fusing nip 307. But, as discussed above, the fusing nip 307 may be formed between the IPR 301 and the EPR 305 without the fuser belt 303. When the IPR 301 is deformed, the radial webs 309 deform in an area that corresponds to the fusing nip 307. However, the radial webs 309 maintain the overall structural shape of the IPR 301 in regions that do not correspond with the fusing nip 307. In other words, the radial webs 309 may be configured to maintain the roll structure of the IPR 301 in regions other than the fusing nip 307 so that the fuser belt 303, if included, may be properly entrained and/or driven by the IPR 301 outside of the fusing nip 307.

Figure 5:
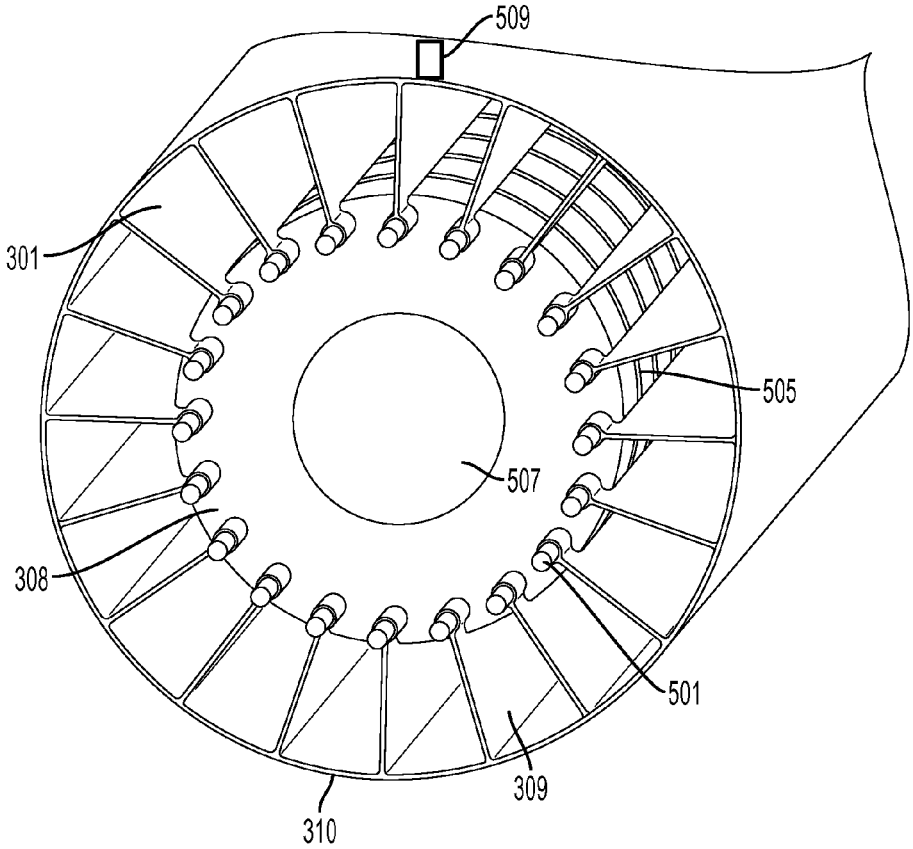
FIG. 5 is a perspective cross-sectional view of an inflatable pressure member in an undeformed state, according to one example embodiment.

FIG. 5 illustrates a cross-sectional perspective view of the IPR 301. In one or more embodiments, the IPR 301, in addition to the core 308, radial webs 309 and outer cylinder 310 may include one or more constraining members 501 that engage key-hole shaped grooves in the core 308. The constraining members 501 attach the radial webs 309 to the core 308 to keep the outer cylinder 310 concentric with a center 507 of the core 308.

According to various embodiments, the core 308 may have grooves 505 cut around the core to let fluid move from a region of the IPR 301 that corresponds to the fusing nip 307 such as deformed chambers formed between the deformed region of the outer cylinder 310 and any deformed radial webs 309 discussed above to the un-deformed chambers. The grooves 505 may be sized to allow enough fluid flow without need to cut them in a center zone of the core 308 to not reduce a section modulus in a higher stressed zone of the core 308. But, in alternative embodiments, grooves 505 or similar channels may be bored into the core 308 to allow fluid to flow through the center zone of the core 308. Similarly, the radial webs 309 may be configured to allow fluid to flow from chamber to chamber bound by the radial webs 309, core 308 and outer cylinder 310 around ends the radial webs 309 that contact the outer cylinder 310 or through holes along the length of the radial webs 309. The IPR 301, in one or more embodiments, may have a valve 509 that may be used to allow inflation and deflation of the IPR 301 either by way of the pressure control member 311 or manually.

Figure 6:
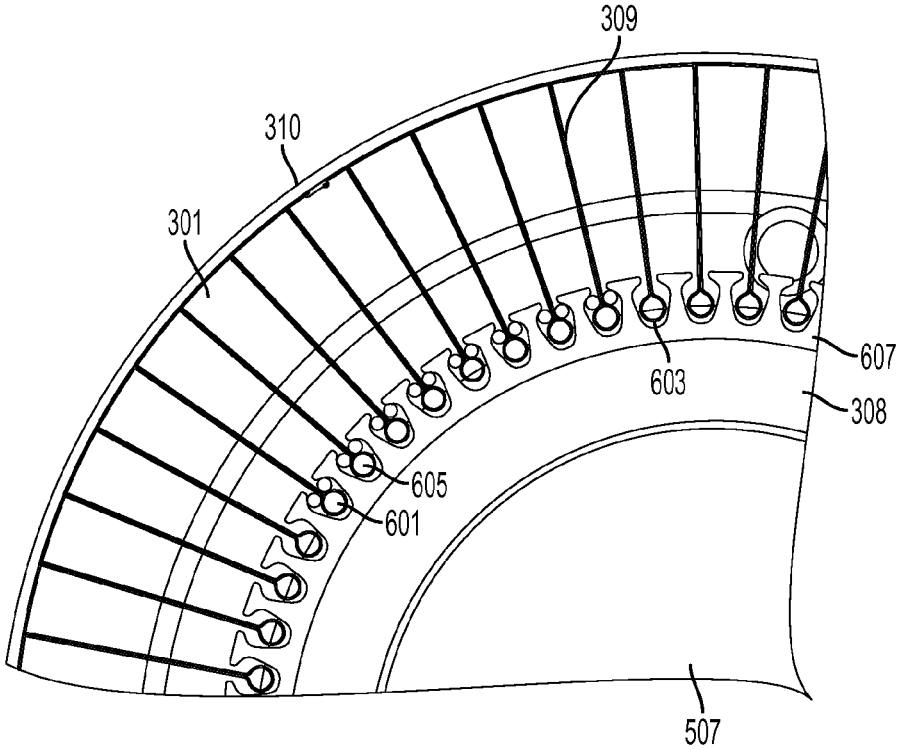
FIG. 6 is a cross-sectional side view of an inflatable pressure member, according to one example embodiment.

FIG. 6 illustrates a cross-sectional side view of the IPR 301 that shows another example for constraining the radial webs 309. In this embodiment, the IPR 301 has radial webs 309 that have loops 603 constrained by one or more long pins 601. The pins 601 are held in place by way of one or more constraining brackets 607 by one or more constraining pins 605. The constraining brackets 607 may be distributed along a length of the core 308. In this embodiment, the pins 601, the constraining pins 605 and the constraining bracket 607 are configured to cause the radial webs 309 to be directed to the center 507 of the core 308 to keep the outer cylinder 310 of the IPR 301 concentric with the core 308.

Figure 7:
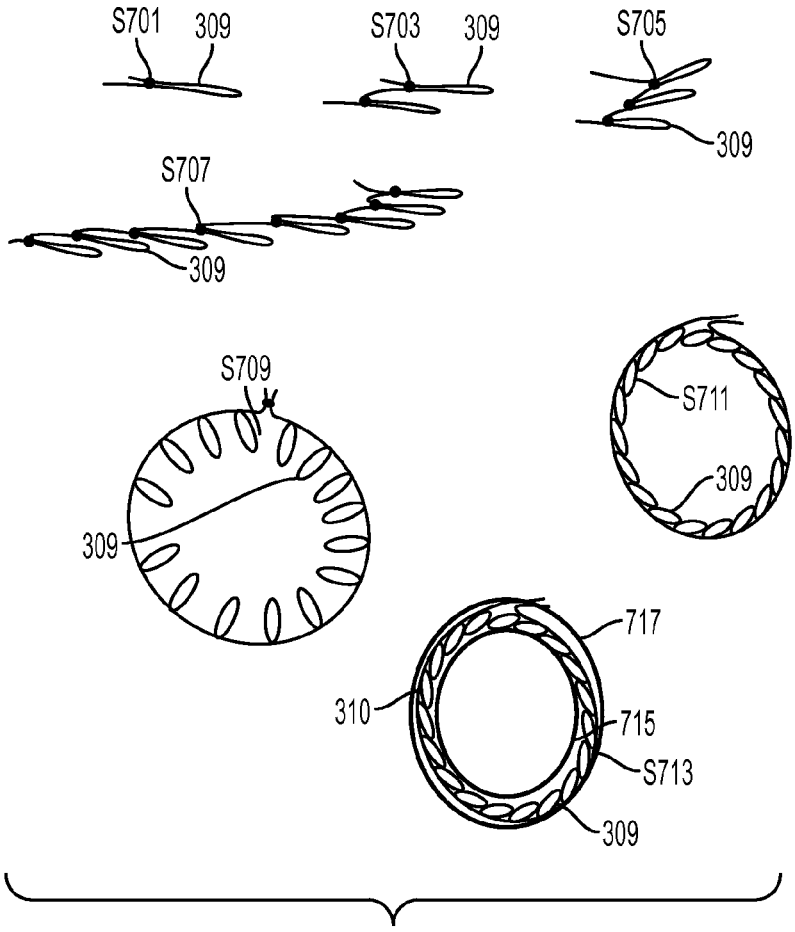
FIG. 7 is a diagrammatical representation of a method for generating one or more radial webs for an inflatable pressure member, according to one example embodiment.

FIG. 7 illustrates a process for fabricating one or more radial webs 309 discussed above. In one or more embodiments, a sheet of polyimide may be thermally bonded into a series of loops equal to the number of radial webs 309 desired. For example, in step S701 one loop is fabricated by folding the polyimide sheet over onto itself. Then, in step S703, another loop is created in the same way. The space between the loops and the loop length may be kept uniform to form three loops for example in step S705, and as many loops as needed in step S707. The ends of the polyimide sheet may then be bound together by welding or other means to form a tube, for example in step S709. In step S711 all the loops may be folded in one direction and the tube may be inserted into a woven sleeve of fiberglass impregnated with un-cured rubber to form the outer cylinder 310 discussed above. Then, in step S713 an air bladder 715 may be inserted inside the bonded polyimide sheet having the radial webs 309 and the assembly enclosed in a mold 717. The air bladder 715 may be inflated inside the mold 717 to expand the bonded polyimide sheet and held in the inflated state until the outer cylinder 310 is cured. After the outer cylinder 310 is cured, the mold 717 may be removed from the assembly and the bladder 715 removed. Once the bladder 715 is removed, the loops may be allowed to unfold to form the radial webs 309 that are configured for connection to the core 308.

Figure 8:
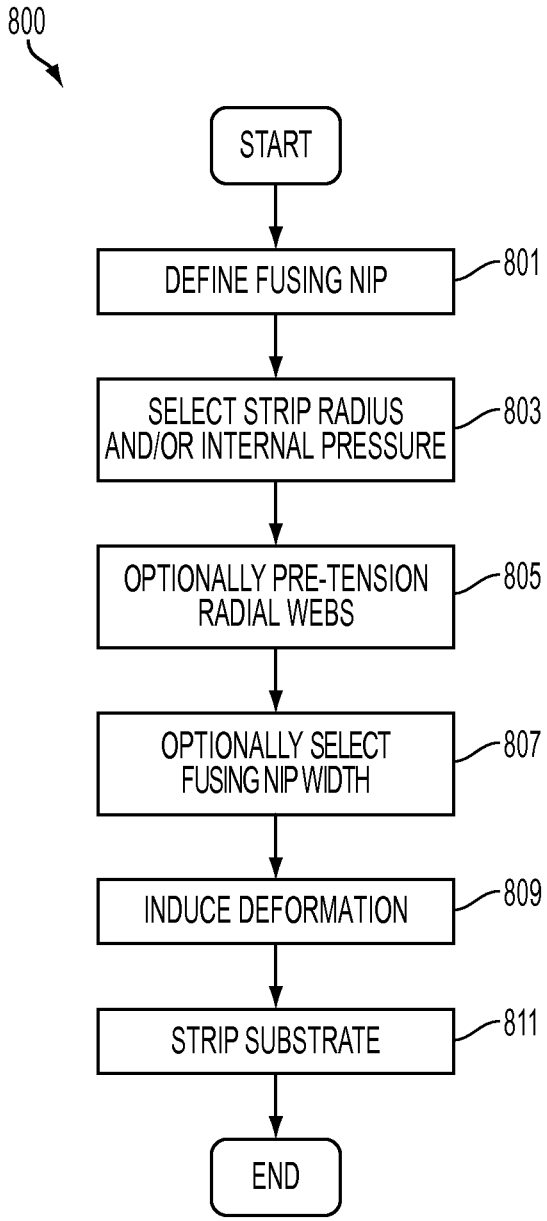
FIG. 8 is a flowchart of a process for stripping a substrate from a fuser belt, according to one example embodiment.
Figure 9:
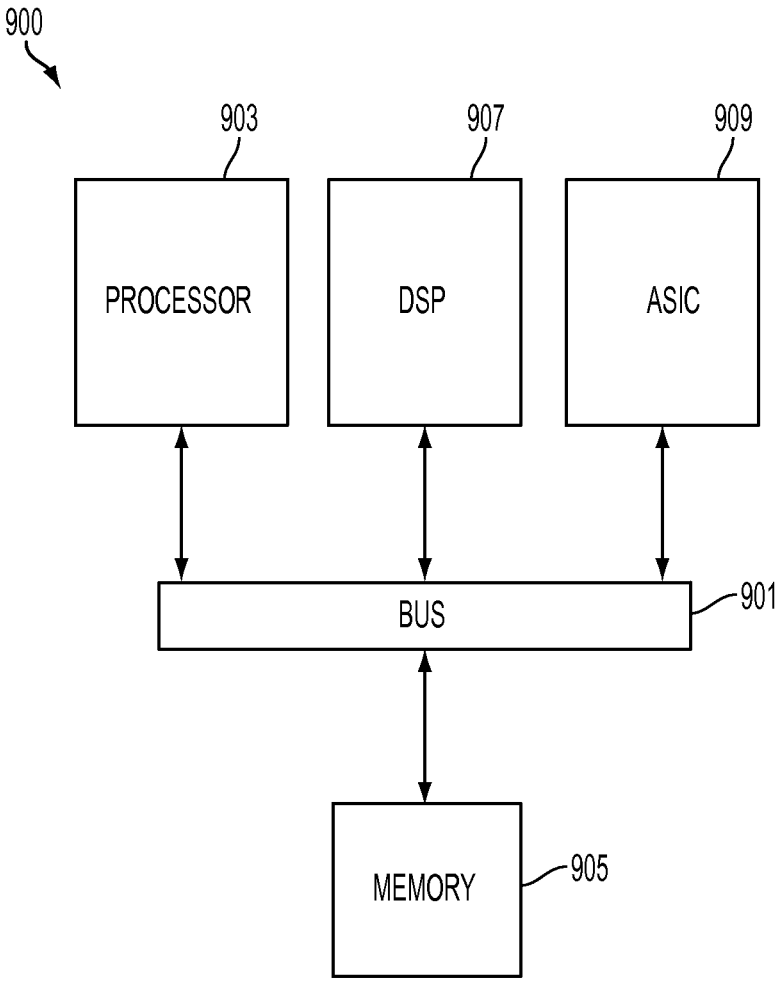
FIG. 9 is a diagram of a chip set that can be used to implement an example embodiment.

FIG. 8 is a flowchart of a process for stripping a substrate from a fuser member such as fuser belt 303 or IPR 301, according to one embodiment. In one embodiment, the fuser 300 performs the process 800 by way of a control module implemented in, for instance, a chip set including a processor and a memory as shown in FIG. 9. In step 801, the fuser 300 defines a fusing nip 307 in the fuser 300. The fuser 300 may have, for example, a pressure member such as the IPR 301 and optionally include a fuser belt 303 that is entrained by the IPR 301. In some embodiments, a portion of the fuser belt 303 faces a surface of the IPR 301 at the fusing nip 307. The fuser 300 may also have a another pressure member such as EPR 305, for example, that has a portion that faces a portion of the fuser belt 303 that is other than the portion of the fuser belt 303 that faces the surface of the IPR 301 at the fusing nip 307. Accordingly, the fuser belt 303 may be entrained between the IPR 301 and the EPR 305. Alternatively, the fuser 300 may simply have a fusing nip that is defined based on a region of contact between the IPR 301 and EPR 305. The fuser 300 may also include a pressure control member 311 configured to selectively inflate the IPR 301, for example, to enable the EPR 305 to induce a customizable deformation in the IPR 301 that controls nip width and strip radius so as to reduce or eliminate the N2/N3 regions discussed above in FIG. 2.

The process continues to step 803 in which one or more of a strip radius, nip width and internal pressure is selected.

Next, in step 805, the fuser 300 optionally causes, at least in part, the radial webs 309 to be pre-tensioned. Alternatively, the radial webs 309 may be pre-tensioned to a degree during fabrication. Then, in step 807, a fusing nip width may be selected. Next, in step 809 the pressure control member 311 may cause the IPR 301 to inflate or deflate to a selected internal pressure to allow the EPR 305 to induce a deformation that corresponds to generating the desired internal pressure, nip width and/or strip radius.

The process continues to step 811 in which a substrate is stripped from the fuser belt 303 or the IPR 301 downstream of the fusing nip 307 at an optimal position on the strip radius 304 based, at least in part, on the selected strip radius.

FIG. 9 illustrates a chip set or chip 900 upon which an embodiment of the invention may be implemented. Chip set 900 is programmed to control a nip pressure profile and strip radius as described herein and includes, for instance, a processor and memory components incorporated as one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 900 can be implemented in a single chip. It is further contemplated that in certain embodiments the chip set or chip 900 can be implemented as a single "system on a chip." It is further contemplated that in certain embodiments a separate ASIC would not be used, for example, and that all relevant functions as disclosed herein would be performed by a processor or processors. Chip set or chip 900, or a portion thereof, constitutes an example means for performing one or more steps of controlling a nip pressure profile and strip radius In one embodiment, the chip set or chip 900 includes a communication mechanism such as a bus 901 for passing information among the components of the chip set 900. A processor 903 has connectivity to the bus 901 to execute instructions and process information stored in, for example, a memory 905. The processor 903 may include one or more processing cores with each core configured to perform independently. A multi-core processor enables multiprocessing within a single physical package. Examples of a multi-core processor include two, four, eight, or greater numbers of processing cores. Alternatively or in addition, the processor 903 may include one or more microprocessors configured in tandem via the bus 901 to enable independent execution of instructions, pipelining, and multithreading. The processor 903 may also be accompanied with one or more specialized components to perform certain processing functions and tasks such as one or more digital signal processors (DSP) 907, or one or more application-specific integrated circuits (ASIC) 909. A DSP 907 typically is configured to process real-world signals (e.g., sound) in real time independently of the processor 903. Similarly, an ASIC 909 can be configured to perform specialized functions not easily performed by a more general purpose processor. Other specialized components to aid in performing the functions described herein may include one or more field programmable gate arrays (FPGA), one or more controllers, or one or more other special-purpose computer chips.

In one embodiment, the chip set or chip 900 includes merely one or more processors and some software and/or firmware supporting and/or relating to and/or for the one or more processors.

The processor 903 and accompanying components have connectivity to the memory 905 via the bus 901. The memory 905 includes both dynamic memory (e.g., RAM, magnetic disk, writable optical disk, etc.) and static memory (e.g., ROM, CD-ROM, etc.) for storing executable instructions that when executed perform the steps described herein to control a nip pressure profile and strip radius. The memory 905 also stores any data associated with or generated by the execution of the steps discussed herein.

While the above apparatuses, methods and systems for controlling a nip pressure profile and strip radius are described in relationship to exemplary embodiments, many alternatives, modifications, and variations would be apparent to those skilled in the art. Accordingly, embodiments of apparatuses, methods and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An apparatus useful in printing comprising:

a first pressure member configured to be inflatable comprising one or more radial webs configured to extend between an external portion of the first pressure member and an internal member of the first pressure member in a direction toward a center of the internal pressure member; and a second pressure member that faces a surface of the first pressure member at a region defining a fusing nip, wherein the second pressure member is configured to cause a deformation of the first pressure member to cause, at least in part, a selectable strip radius downstream of the fusing nip in a process direction, wherein the deformation caused by the second pressure member is based, at least in part, on a selectable internal pressure of the first pressure member; and a first pressure member inflation control element configured to change the internal pressure of the first pressure member on demand.

2. The apparatus of claim 1, wherein the deformation caused by the second pressure member is further based, at least in part, on a stiffness of the one or more radial webs.

3. The apparatus of claim 2, wherein the selectable strip radius is further caused, at least in part, by a pre-tensioning of the one or more radial webs that causes another deformation of the first pressure member.

4. The apparatus of claim 1, wherein the fusing nip has a uniform pressure from a fusing nip entrance to a fusing nip exit in the process direction.

5. The apparatus of claim 4, wherein a fusing nip width from the fusing nip entrance to the fusing nip exit is selectable based, at least in part, on the selectable internal pressure of the first pressure member.

6. The apparatus of claim 1, wherein a fusing pressure in the fusing nip is equal to the selectable internal pressure of the first pressure member.

7. The apparatus of claim 1, wherein the first pressure member is inflated with air.

8. The apparatus of claim 1, wherein the internal member of the first pressure member comprises one or more retaining members configured to constrain the one or more radial webs.

9. The apparatus of claim 1, further comprising:

a fuser belt entrained between the first pressure member and the second pressure member in the fusing nip.

10. A method for stripping a substrate in a printing process comprising:

defining a fusing nip in an apparatus useful in printing, the apparatus comprising:

a first pressure member configured to be inflatable comprising one or more radial webs configured to extend between an external portion of the first pressure member and an internal member of the first pressure member in a direction toward a center of the internal pressure member; and a second pressure member that faces a surface of the first pressure member at a region defining a fusing nip, causing, at least in part, a selectable strip radius downstream of the fusing nip in a process direction by causing a deformation of the first pressure member with the second pressure member; and causing, at least in part, stripping of the substrate downstream of the fusing nip in a process direction; and selecting an internal pressure of the first pressure member, wherein the deformation caused by the second pressure member is based, at least in part, on the selectable internal pressure of the first pressure member.

11. The method of claim 10, wherein the deformation caused by the second pressure member is further based, at least in part, on a stiffness of the one or more radial webs.

12. The method of claim 11, further comprising:

causing, at least in part, a pre-tensioning of the one or more radial webs to cause another deformation of the first pressure member, wherein the selectable strip radius is further caused, at least in part, by the pre-tensioning of the one or more webs.

13. The method of claim 10, wherein the fusing nip has a uniform pressure from a fusing nip entrance to a fusing nip exit in the process direction.

14. The method of claim 13, further comprising:

selecting a fusing nip width from the fusing nip entrance to the fusing nip exit based, at least in part, on the selected internal pressure of the first pressure member.

15. The method of claim 10, wherein a fusing pressure in the fusing nip is equal to the selectable internal pressure of the first pressure member.

16. The method of claim 10, wherein the first pressure member is inflated with air.

17. The method of claim 10, wherein the internal member of the first pressure member comprises one or more retaining members configured to constrain the one or more radial webs.

18. The method of claim 10, wherein a fuser belt is entrained between the first pressure member and the second pressure member in the fusing nip.

19. An apparatus useful in printing comprising:

an inflatable roll comprising one or more radial webs configured to extend between an external portion of the inflatable roll and an internal member of the inflatable roll in a direction toward a center of the inflatable roll, wherein the internal member of the inflatable roll comprises one or more retaining members configured to constrain the one or more radial webs.

20. The apparatus of claim 19, wherein an amount the inflatable roll is deformed is based, at least in part, at least in part, on a stiffness of the one or more radial webs.

21. The apparatus of claim 20, wherein the inflatable roll is further deformable based, at least in part, on a pre-tensioning of the one or more radial webs.

22. The apparatus of claim 19, wherein the one or more retaining members comprise one or more pins.

23. The apparatus of claim 19, wherein the one or more retaining members are constrained by one or more key-hole grooves configured to engage the one or more retaining members.

24. The apparatus of claim 23, wherein the one or more retaining members are constrained by one or more constraining brackets positions on the internal member.

25. The apparatus of claim 19, further comprising:

one or more chambers between sequential one or more radial webs; and one or more grooves in the internal member, wherein the one or more grooves in the internal member are configured to allow a fluid to pass between at least one of the one or more chambers and any of the other one or more chambers when the at least one or the one or more chambers is deformed.

* * * * *